United States Patent [19]

Boll

[11] 4,265,684

[45] May 5, 1981

[54] MAGNETIC CORE COMPRISED OF LOW-RETENTIVITY AMORPHOUS ALLOY

[75] Inventor: Richard Boll, Muhlheim, Fed. Rep. of Germany

[73] Assignee: Vacuumschmelze GmbH, Fed. Rep. of Germany

[21] Appl. No.: 57,971

[22] Filed: Jul. 16, 1979

[30] Foreign Application Priority Data

Jul. 26, 1978 [DE] Fed. Rep. of Germany ..... 2832731

[51] Int. Cl.[3] ..... H01F 1/00

[52] U.S. Cl. ..... 148/121; 29/603; 148/31.55; 360/120

[58] Field of Search ..... 29/603; 360/120; 148/100, 101, 104, 121, 31.55, 31.57

[56] References Cited

U.S. PATENT DOCUMENTS

| | | | |
|---|---|---|---|
| 3,258,542 | 6/1966 | Pfost | 360/120 |
| 4,079,430 | 3/1978 | Fujishima et al. | 360/126 |
| 4,150,981 | 4/1979 | O'Handley | 75/170 |
| 4,152,144 | 5/1979 | Hasegawa et al. | 75/122 |

FOREIGN PATENT DOCUMENTS

| | | |
|---|---|---|
| 2546676 | 10/1974 | Fed. Rep. of Germany . |
| 2553003 | 11/1974 | Fed. Rep. of Germany . |

*Primary Examiner*—L. Dewayne Rutledge
*Assistant Examiner*—John P. Sheehan
*Attorney, Agent, or Firm*—Hill, Van Santen, Steadman, Chiara & Simpson

[57] ABSTRACT

An amorphous alloy core is converted into a crystalline state at least at one zone along the core body and such zone extends at least over a portion of the core cross-section at such zone. The zone converted into the crystalline state functions as an air gap of prior art crystalline low-retentivity alloy cores, because the permeability in the crystalline state is significantly lower than in the amorphous state. Magnetic cores formed in accordance with the principles of the invention are suitable in applications wherever a sheared hysteresis loop is required.

8 Claims, 4 Drawing Figures

MAGNETIC CORE COMPRISED OF LOW-RETENTIVITY AMORPHOUS ALLOY

BACKGROUND OF THE INVENTION

1. Field of the Invention

The invention relates to magnetic cores having a sheared hysteresis loop and somewhat more particularly to magnetic cores comprised of a low-retentivity amorphous alloy.

2. Prior Art

Electromagnetic elements comprised of magnetic cores formed of low-retentivity amorphous alloys are known, for example see German Offenlegungsschrift No. 25 46 676 and 25 53 003.

As is known, amorphous metal alloys can be manufactured by cooling a suitable melt so quickly that a solidification without crystallization occurs. In this manner, precisely during formation, alloy bodies can be produced in the form of relatively thin bands or strips having a thickness of, for example, a few hundredths of a millimeter and a width which can range from a few millimeters through several centimeters.

Amorphous alloys can be distinguished from crystalline alloys, for example, by means of X-ray diffraction analysis. In contrast to crystalline materials which exhibit characteristically sharp diffraction lines, amorphous metal alloys exhibit broad peaks, the intensity of which change only slowly with the diffraction angle, similar to that of liquids or common glass.

Depending upon the manufacturing conditions, an amorphous alloy can be completely amorphous or comprise a two-phase mixture of amorphous and crystalline states. In general, an amorphous metal alloy is understood in the art as comprising an alloy which is at least 50% amorphous and more preferably at least 80% amorphous.

Each amorphous metal alloy has a characteristic temperature, a so-called crystallization temperature. If one heats an amorphous alloy to or above this characteristic temperature, then the alloy changes into a crystalline state, in which it remains after cooling. However, with heat treatments below the crystallization temperature, the amorphous state is retained.

Heretofore known amorphous metal alloys have the composition $M_yX_{1-y}$ wherein M represents at least one of the metals selected from the groups consisting of iron, cobalt and nickel and X represents at least one of the so-called glass-forming elements selected from the group consisting of boron, carbon silicon and phosphorous and y is a numeral ranging between approximately 0.60 and 0.95. In addition to the above-enumerated metals M, known amorphous alloys can also contain further metals, such as titanium, zirconium, hafnium, vanadium, niobium, tantalum, chromium, molybdenum, tungsten, manganese, palladium, platinum, copper, silver and/or gold. Further, the elements aluminum, gallium, indium germanium, tin, arsenic, antimony, bismuth and/or beryllium can also be present in addition to the above-enumerated glass-forming elements X or, under certain conditions, in place thereof.

Amorphous low-retentivity alloys are particularly suited for manufacture of magnetic cores since, as mentioned above, they can be produced directly in the form of thin bands without the necessity, as in the manufacture of crystalline low-retentivity metal alloys (which have been standard up to now in the art), to carry out a multitude of rolling and/or forming steps, with numerous intermediate annealings.

For various applications, for example, in chokes, cores with sheared hysteresis loops are often employed. As is known, one can achieve a shearing in cores comprised of standard crystalline low-retentivity alloys by providing an air gap at least at one location along the core body, which air gap then extends over the entire core cross-section at such location.

Such air gaps must often be produced in a relatively expensive manner or the cores must be completely cut-through at select locations in order to create the air gap, as is the case, for example, in cut tape cores so that additional elements for holding the core together, for example, tightening straps and the like, are required.

SUMMARY OF THE INVENTION

The invention provides a sheared magnetic core comprised of low-retentivity amorphous alloy which does not require an air gap.

In accordance with the principles of the invention, a magnetic core comprised of an amorphous alloy is converted into a crystalline state at least at one continuous area or zone extending within the core body over at least a portion of the core cross-section of such body so as to function in the manner of an air gap in a standard crystalline low-retentivity magnetic core.

In accordance with the principles of the invention, the amorphous alloy utilized in forming the magnetic core is preferably completely amorphous. In certain embodiments of the invention, the crystalline zone produced at one zone of the core body extends across the entire core cross-section at such zone. In certain other preferred embodiments of the invention, the width of the produced crystalline zone varies across the core cross-section.

In accordance with the principles of the invention, amorphous low-retentivity alloys having a relatively high permeability in the amorphous state are subjected to a localized over-heating at select zones or area thereof to a temperature above the crystallization temperature of such alloy so that a crystalline state is attained at the heated zones and which exhibits a permeability which is significantly reduced from that in the amorphous state. In this manner, a crystallization zone is provided at least at one area or zone along a core body and such zone extends at least over a part of the core cross-section. Such crystalline zone functions similar to an air gap.

In order to achieve the greatest possible permeability difference between a crystalline zone and the remaining amorphous portions of a magnetic core, a completely amorphous low-retentivity alloy is preferable utilized as the base material in forming such cores.

Depending on the planned end use of a magnetic core, one or more crystallization zones can be provided in a select pattern along the core body and the width of such crystallization zones across the core cross-section may, if desired, vary.

DESCRIPTION OF THE PREFERRED EMBODIMENT

The invention provides an amorphous metal alloy core having at least one continuous crystalline zone extending within the core body, over at least a portion of the core body cross-section so as to function in a manner similar to an air gap.

In accordance with the principles of the invention, magnetic cores are manufactured, for example, by winding an amorphous metal alloy band into a core body or by stacking sheets stamped out of an amorphous metal alloy tape so as to form a core body. Localized heating of such core bodies above the crystallization temperature of the alloy for generating a crystalline zone at select areas along such cores can then occur, for example, by providing an electrically operative induction loop positioned around a core body at select locations. Before the production of such crystalline zones, the magnetic core can be heat-treated for example, in a known manner at a temperature below the crystallization temperature, in the presence of a magnetic field so as to magnetize the core body approximately up to saturation. Such magnetic field can be a magnetic cross-field or a magnetic longitudinal field.

In embodiments where a core of substantially large dimensions is contemplated, such core may be difficult to heat across its entire cross-section. In such instances, it is recommended that such large cores be formed from a plurality of stacked sheets, each of which has at least one crystalline zone extending across at least a portion of its cross-section or across its entire cross-section. Such crystalline zones in the sheets are, of course, produced before the sheets are stacked into a core body and such crystalline zones are aligned with one another so that the resultant core body has at least one uniform crystalline zone extending across at least a portion of the body cross-section.

Similar process can be utilized in embodiments wherein only a specific portion of core cross-section is to be converted in a crystalline zone. In these embodiments, heating can occur, for example, via electrical resistance heating between two metal surfaces function as contacts or via the application of a controlled laser beam.

Figure 1:
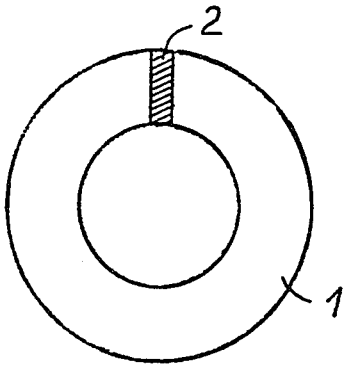
FIGS. 1–4 are somewhat schematic top views of exemplary embodiments of magnetic cores produced in accordance with the principles of the invention.

Referring now to the drawings, FIG. 1 illustrates a magnetic core constructed, for example, from a plurality of stacked disks 1 of a low-retentivity amorphous metal alloy, in which a select zone 2 has been converted into a crystalline state by means of induction heating. As shown, the crystalline zone 2 is continuous, extending within the core body in the manner of an air gap, over at least a portion of the cross-section of the core body.

In an exemplary embodiment, disks having an interior diameter of 20 mm and an exterior diameter of 30 mm are formed from a low-retentivity amorphous alloy having the composition:

$$Fe_{0.40}Ni_{0.40}P_{0.14}B_{0.06}$$

A plurality of such disks are stacked into a core body having a height of 10 mm. Such core body exhibits a permeability, $\mu$, a 250,000 (measured as a constant field permeability at 4 mA/cm) in the amorphous material after an appropriate annealing treatment in a magnetic field. Upon conversion of a portion of such core body into a crystalline state by means of a localized heating to a temperature above the crystallization temperature of approximately 400° C., the foregoing permeability is reduced within the crystalline zone to approximately 500. In the exemplary embodiment, such crystalline zone is 5 mm in width and, accordingly, corresponds to an apparent air gap with a length of 0.01 mm. The average iron path length in the core body, given the above exemplary dimensions, is about 78.5 mm and exhibits a permeability in the sheared circuit of approximately 7630.

Figure 2:
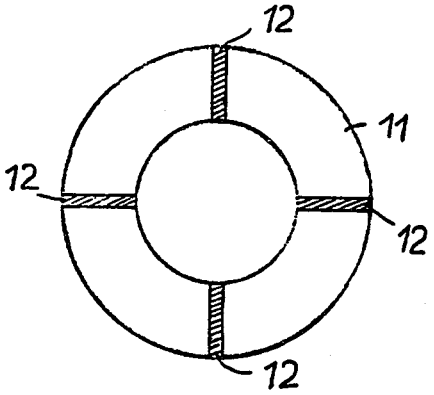

FIG. 2 shows another exemplary embodiment of a core body which can, for example, be formed by stacking a plurality of sheets or winding a relatively thin tape into the form of a toroidal tape core. Four crystallization zones 12 can be provided within the core and, as shown, be equally spaced from one another and extend over the entire core cross-section. Of course, such zones may also be so positioned so that one or more of such zones are spaced at varying distances from other of such zones and select ones of such zones may extend over only a portion of the core cross-section. Such crystallization zones can be created by means of localized heating of an amorphous material 11, for example at four locations about the core circumference.

Figure 3:
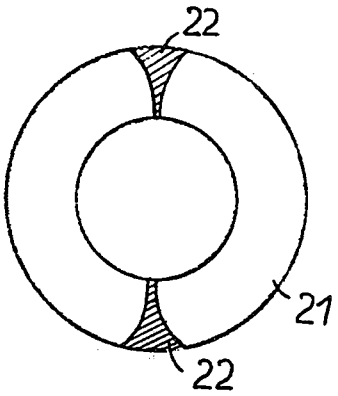

FIG. 3 shows yet another exemplary embodiment of a magnetic core produced in accordance of the principles of the invention having crystallized zones 22 which have limiting boundaries that are curved and have been created in the amorphous material 21 at two spaced-apart areas in the core body. For example, non-linear characteristics can be achieved by means of such curved crystallization zones whose width varies over the core cross-section.

Figure 4:
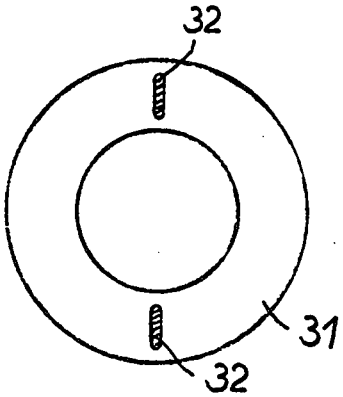

FIG. 4 shows yet a further exemplary embodiment of a magnetic core produced in accordance of the principles of the invention wherein the crystalline zones 32 extend only over a portion of the core cross-section. As shown, such crystallization zone can be created in an amorphous metal alloy 31 at two substantially opposing locations or in some other geometric pattern.

As shown by the exemplary embodiments illustrated in FIGS. 1 through 4, one can vary the shearing within wide limits by means of different selections of crystallization zones. In this manner, for example, flat hysteresis loops, Perminvarlike hoops, strongly sheared linear loops or non-linear characteristic loops can be attained.

In embodiments where a plurality of crystalline zones are provided along a core circumferences, then, as in the case of a powder core, a uniform shearing with low magnetic diffusion can be attained. Cores produced in accordance with the principles of the invention can be bonded, positioned in protective shields or be cast in a traditional manner.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

I claim as my invention:

1. A magnetic core composed of an at least 50% amorphous low-retentivity metal alloy having at least one continuous zone composed of said alloy in crystalline form extending within said core in the manner of an air gap, over at least a portion of the cross-section of said core.

2. A magnetic core as defined in claim 1 wherein said alloy is completely amorphous, except for said continuous crystalline zone.

3. A magnetic core as defined in claim 1 wherein said zone composed of said alloy in crystalline form extends over the entire cross-section of said body.

4. A magnetic core as defined in claim 3 wherein the width of said zone varies across the cross-section of said body.

5. A magnetic core as defined in claim 1 wherein a plurality of zones composed of said alloy in crystalline form are located along said body and spaced apart from one another.

6. A magnetic core as defined in claim 5 wherein said plurality of zones are equally spaced apart from one another.

7. A method of producing a magnetic core from a low-retentivity amorphous metal alloy comprising:

forming a core body from an at least 50% amorphous low-retentivity metal alloy, and converting at least one select continuous zone within said body into a crystalline state so that such zone extends over at least a portion of the cross-section of said body in the manner of an air gap by heating said zone to the crystallization temperature of said alloy.

8. A method of producing a magnetic core from a low-retentivity amorphous metal alloy comprising:

producing a plurality of stacking sheets from an at least 50% amorphous low-retentivity metal alloy, said sheets being formable into a uniform core body;

converting at least one select continuous zone within each of said sheets into a crystalline zone extending over at least a portion of the cross-section of each of said sheets in the manner of an air gap by heating each of said zones to the crystallization temperature of said alloy; and forming a uniform core body from said sheets so that said crystallization zone in each sheet is aligned with the crystallization zone in each other sheet to define a uniform crystallization zone extending over at least a portion of the body cross-section in the manner of an air gap.

* * * * *